US005743101A

United States Patent [19]

Shida et al.

[11] Patent Number: 5,743,101

[45] Date of Patent: Apr. 28, 1998

[54] AIR-CONDITIONER

[75] Inventors: Yasunori Shida; Yukihiko Iwata; Takashi Watanabe; Akihiro Kobayashi, all of Tokyo; Osamu Kamiya, Aichi; Tatsunao Hayashida, Tokyo, all of Japan

[73] Assignee: Mitsubishi Denki Kabushiki Kaisha, Tokyo, Japan

[21] Appl. No.: 739,835

[22] Filed: Oct. 30, 1996

[30] Foreign Application Priority Data

Nov. 17, 1995 [JP] Japan ..... 7-299872

[51] Int. Cl.[6] ..... F24F 11/02

[52] U.S. Cl. ..... 62/175; 236/51; 165/208

[58] Field of Search ..... 62/175, 180, 179, 62/203; 236/49.3, 51; 165/205, 208, 207, 218, 217

[56] References Cited

U.S. PATENT DOCUMENTS

| | | | |
|---|---|---|---|
| 4,811,897 | 3/1989 | Kobayashi et al. | 236/51 X |
| 4,997,030 | 3/1991 | Goto et al. | 236/49.3 X |
| 5,279,458 | 1/1994 | DeWolf et al. | 236/51 X |
| 5,592,824 | 1/1997 | Sogabe et al. | 62/175 X |

FOREIGN PATENT DOCUMENTS

| | | |
|---|---|---|
| 0647820 | 4/1995 | European Pat. Off. . |
| 5-26501 | 2/1993 | Japan . |
| 6-58601 | 3/1994 | Japan . |
| 6-257829 | 9/1994 | Japan . |
| 2257538 | 1/1993 | United Kingdom . |

*Primary Examiner*—Harry B. Tanner

*Attorney, Agent, or Firm*—Oblon, Spivak, McClelland, Maier & Neustadt, P.C.

[57] ABSTRACT

A multi-air-conditioner includes an exterior unit, interior units and remote-controllers. The exterior unit collects operation data of each of the interior units, determines an operation condition, and transmits the operation condition to each of the interior units. The interior units transmit the operation condition to the exterior unit, receive the operation condition from the exterior units, receive the operation setting condition from the remote-controllers, set an operation condition based on the operation setting condition which is received from the remote-controllers and the exterior unit, and transmit the operation condition to the remote-controllers. The remote-controller receives the operation condition from the interior units and transmits the operation setting condition to the interior units.

17 Claims, 7 Drawing Sheets

AIR-CONDITIONER

BACKGROUND OF THE INVENTION

1. Field of the Invention

The present invention relates to a multi-air-conditioner in which a single exterior unit operates a plurality of interior units in a same condition.

2. Description of the Related Art

A multi-air-conditioner according to the related art is disclosed in Japanese Unexamined Published Patent Application HEI 1-208647.

A configuration of the multi-air-conditioner of Hei 1-208647 is illustrated in FIG. 11. In FIG. 11, a remote-controller 91, interior units 92, 100 and 101, an exterior unit 93, interior controllers 94, 94*a* and 94*b*, an exterior controller 95, a remote-controller-interior-unit transmission line 96, an interior-exterior transmission line 97, and inter-interior-units transmission lines 98 and 99 are illustrated.

A power supply of each of the interior units 92, 100 and 101 is controlled by the exterior unit 93, and air-conditioning is performed when all the interior units are "ON."

In the multi-air-conditioner of FIG. 11 according to the related art, an operation input from the remote-controller 91 is inputted to the interior controller 94 in the interior unit 92 via the remote-controller-interior-unit transmission line 98. At the same time, the operation input is transmitted to each of the interior controllers 94*a* and 94*b* of the other interior units 100 and 101 via the inter-interior-units transmission line 98.

A transmission to the exterior unit 93 is performed in an order which is set by a DIP (dial in-line package) switch in the interior controller 94. The operation input is transmitted to the exterior controller 95 in the exterior unit 93 via the interior-exterior transmission line 97 and the inter-interior-units transmission line 99. The exterior controller 95 in the exterior unit operates a compressor, etc. (not illustrated in FIG. 11) in the exterior unit 93, only when the number of interior units exceeds the number of interior units which can be connected to the exterior unit under the current operation condition by receiving an operation command which is generated by the operation input.

Generally, when the multi-air-conditioner according to the related art is connected an upper control system, each of the interior units and a controller in the upper control system are connected.

The multi-air-conditioner which is disclosed in Japanese Unexamined Patent Application HEI 1-208647 is configured as stated above. Therefore, a plurality of interior units are able to operate simultaneously in the same condition. However, it is necessary to connect one of the interior units and the exterior unit by the transmission line, and it is also necessary to connect each of the interior units serially by the plurality of transmission lines. Hence, wiring work is hard, and a wiring cost is high.

Generally, when the multi-air-conditioner according to the related art is connected to an upper control system, each of the interior units and the controller in the upper control system are connected, or a transmission converter for the controller in the upper control system is connected to each of the interior units. In the first case, Transmission H/W (hardware) and S/W (software) for the upper control system must be provided in each of the interior units. Hence, the cost is high. In the second case, when the transmission converter is additionally connected to the upper control system, installation work is difficult. Further, the interior unit may not have an extra space for placing the transmission converter.

SUMMARY OF THE INVENTION

Accordingly, it is an object of this invention to solve the above-stated problems in the related art. The present invention provides for a low-price air-conditioner which is able to be installed with easy wiring work. Also, the present invention provides for a low-price air-conditioner which is able to be connected to an upper control system with easy installation work.

The air-conditioner according to this invention comprises an exterior unit, a plurality of interior units connected to the exterior unit, a transmitter which transmits data between the exterior unit and the plurality of interior units connected to the exterior unit, an operation commander connected to at least one of the exterior unit and the plurality of interior ,units, which sets an operation condition and a controller, provided in the exterior unit. The controller collects data of operation which is performed by the connected interior units based on an command from the operation commander, determines a same operation condition for each of the connected interior units based on the operation data from the interior units, and instructs each of the interior units to perform the determined operation via the transmitter. Further, each of the plurality of interior units operates in a same condition.

The air-conditioner comprises a single or a plurality of exterior units and a single or a plurality of interior units connected to the exterior units. Further, the plurality of interior units operates in a same condition.

The exterior unit comprises an interior-exterior transmission receiver which collects operation data of each of the connected interior units, an interior unit operation setter which determines a same operation condition of each of the interior units based on the operation data of each of the interior units, and an interior-exterior transmitter which transmits the operation condition of each of the interior units to each of the interior units.

The interior unit comprises the interior-exterior transmitter which transmits operation data to the exterior units, the interior-exterior transmission receiver which receives an operation condition from the exterior units, and an operation setter which sets an operation condition based on the operation condition received from the exterior units.

A control method of the air-conditioner according to this invention includes an exterior unit, a plurality of interior units connected to the exterior unit, a transmitter which transmits data between the exterior unit and the plurality of interior units connected to the exterior unit and an operation commander, connected to at least one of the exterior unit and the interior units, which sets an operation condition.

The control method comprises an interior unit control step, which includes controlling the interior units based on the operation condition from the operation commander, and when another operation condition is received from the exterior units, controlling the interior units based on the new operation condition, and an exterior unit control step, which includes receiving the operation setting condition from a single or a plurality of interior units, determining a condition of simultaneous operation of all the interior units by the exterior units, and transmitting the operation condition so that each of the interior units operate in a same condition.

Other objects features, and advantages of the invention will be apparent from the following description when taken in conjunction with the accompany drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Embodiment 1

Figure 1:
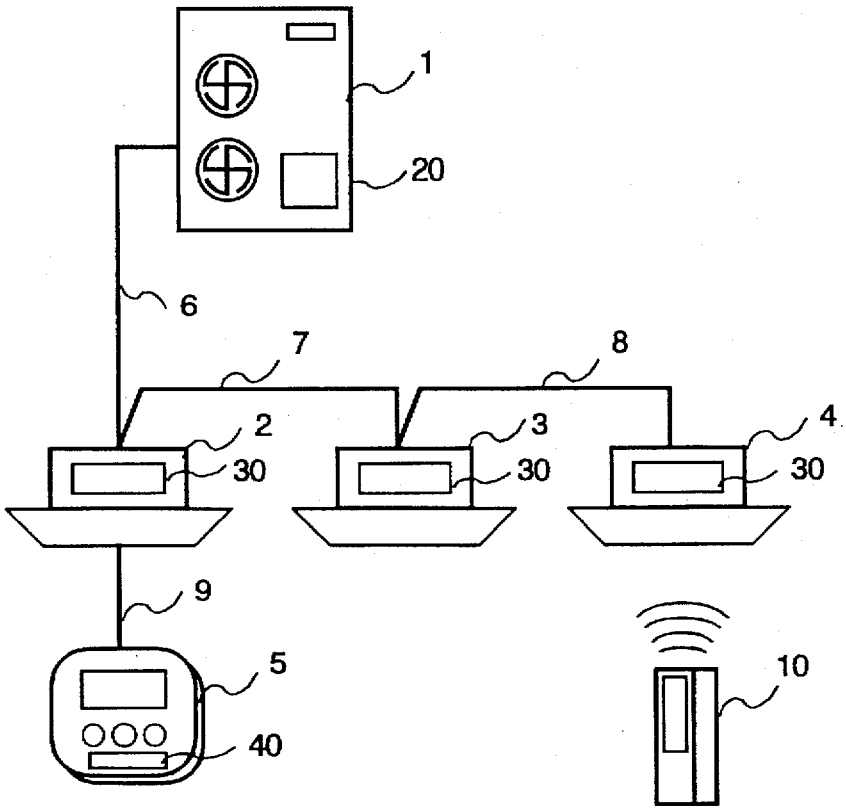
FIG. 1 is a configuration block chart of the multi-air-conditioner of the present invention, which operates simultaneously in embodiment 1.

Referring now to the drawings, wherein like reference numerals designate identical or corresponding parts throughout the several views, an example of embodiment 1 will now be explained.

A multi-air-conditioner which operates simultaneously in a same condition according to embodiment 1 is configured as illustrated in the block chart of FIG. 1. In FIG. 1, an exterior unit 1, interior units 2–4 and a remote-controller 5 of a wired type are illustrated. In FIG. 1, each of transmission lines 6–8 between the exterior unit 1 and each of the interior units 2–4 are illustrated. A transmission line 9 between the remote-controller 5 and the interior unit 2 and a remote-controller 10 of a wireless type are also illustrated.

Figure 2:
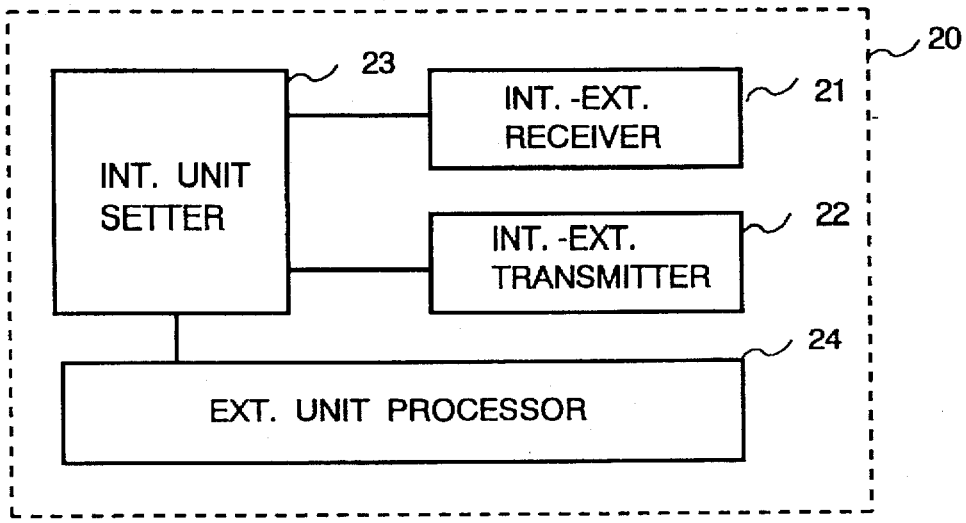
FIG. 2 is a block chart of the controller of the exterior unit which is illustrated in FIG. 1.
Figure 3:
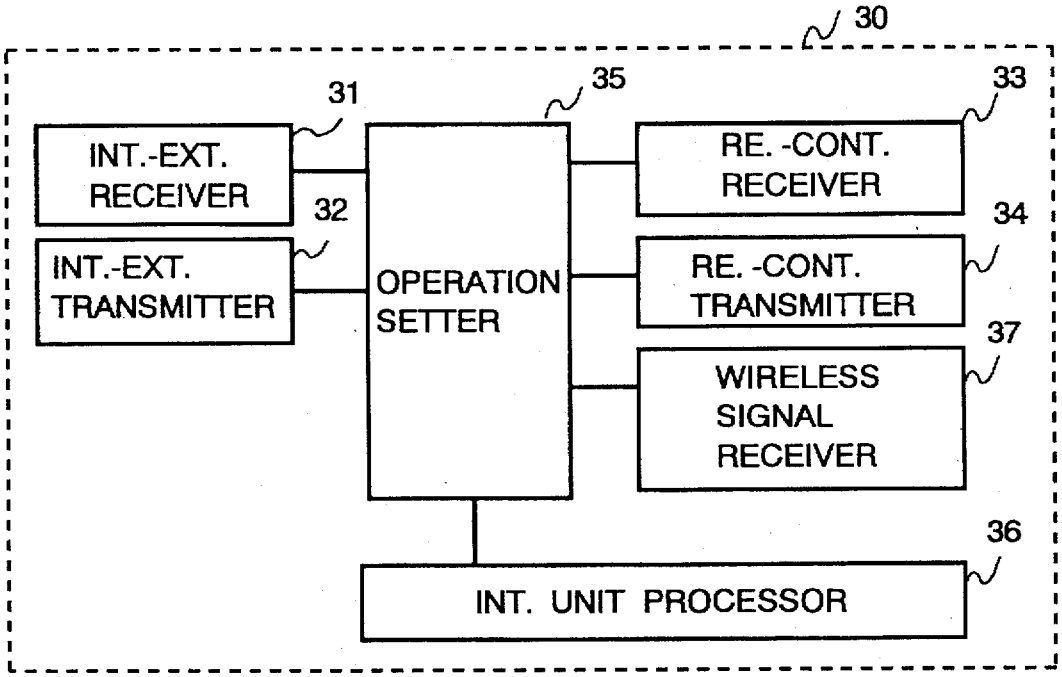
FIG. 3 is a block chart of the controller of the interior unit which is illustrated in FIG. 1.
Figure 4:
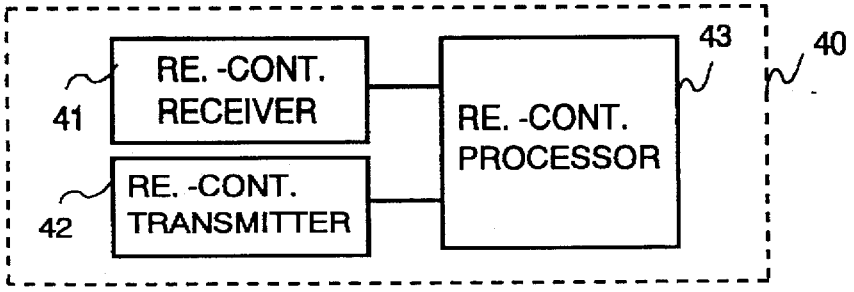
FIG. 4 is a block chart of the controller of the remote-controller of a wired type which is illustrated in FIG. 1.

FIG. 2 illustrates a configuration block chart of a controller in the exterior unit 1. FIG. 3 illustrates a configuration block chart of a controller in each of the interior units 2–4. FIG. 4 illustrates a configuration block chart of a controller in the remote-controller 5.

In FIG. 2, a controller 20 in the exterior unit 1 includes an interior-exterior transmission receiver 21 which receives operation data from the interior units, and an interior-exterior transmitter 22 which transmits an operation setting condition to the interior units. The controller 20 also includes an interior unit operation setter 23 which sets a condition of a simultaneous operation of each of the interior units according to operation data for each of the interior units which is received by the interior-exterior transmission receiver 21. The controller 20 also includes an exterior unit processor 24 which controls the exterior unit.

In FIG. 3, a controller 30 in each of the interior units 2–4, an interior-exterior transmission receiver 31 which receives an operation setting condition from the exterior unit, an interior-exterior transmitter 32 which transmits an operation data to the exterior unit, and a remote-controller transmission receiver 33 which receives the operation setting condition from the remote-controller are illustrated. A remote-controller transmitter 34 which transmits an operation condition to the remote-controller, and an operation setter 35 which sets an operation condition of each of the interior units according to an operation condition which is received by the interior-exterior transmission receiver 31 or the remote-controller transmission receiver 33 are also illustrated. In FIG. 3, an interior unit processor 36 which controls each of the interior units, and a wireless signal receiver 37 which receives a signal from the remote-controller 10 of a wireless type are also illustrated.

In FIG. 4, a controller 40 in the remote-controller 5, and a remote-controller transmission receiver 41 which receives an operation condition from each of the interior units are illustrated. A remote-controller transmitter 42 which transmits the operation condition to each of the interior units, and a remote-controller processor 43 which controls the remote-controller are also illustrated.

An operation of the multi-air-conditioner with the above-stated configuration which operates simultaneously in a same condition will now be explained.

In FIG. 1, each of the interior units 2–4 is connected to the exterior unit 1. An operation condition of each of the interior units 2–4 is set by the remote-controller 5 or the remote-controller 10 of a wireless type, and each of the interior units 2–4 operates simultaneously in a same condition.

An operation of the multi-air-conditioner in case that an operation condition is set by the remote-controller 5 is explained. The controller of the remote-controller is configured as illustrated in FIG. 4. When an operation condition is set by an operation setting switch (not illustrated), etc., the remote-control processor 43 transmits the operation setting condition to the interior unit 2 by the remote-controller transmitter 42.

The controller of the interior unit 2, which is configured as illustrated in FIG. 3, receives the operation setting condition from the remote-controller by the remote-controller transmission receiver 33, and determines an operation condition by the operation setter 35. The controller controls the interior units by the interior unit processor 36 based on the determined operation condition. The controller also transmits the operation condition and operation data to the exterior unit 1 and the remote-controller 5 by the interior-exterior transmitter 32 and the remote-controller 20 transmitter The controller of the exterior unit 1 is configured as illustrated in FIG. 2. When the controller receives an operation condition by the interior-exterior transmission receiver 21, the controller determines a condition of a simultaneous operation of all the interior units and controls the exterior unit based on the determined condition by the exterior unit processor. The controller also transmits the operation condition to the interior units 2–4 by the interior-exterior transmitter 22. When the interior units 2–4 receives the operation condition by the interior-exterior transmission receiver 31, each of the interior units determines an operation condition by the operation setter 35, and controls the interior units based on the determined operation condition by the interior unit processor As stated, when an operation setting condition is received from the remote-controller 5, the interior unit 2 which is connected to the remote-controller starts operation based on the received operation setting condition, and transmits the operation condition to the exterior unit 1. Then, the exterior unit 1 transmits the operation setting condition to each of the interior units 2–4, and all of the interior units operate simultaneously.

When the remote-controller 10 of a wireless type is used to set an operation condition, operation is performed as follows.

When the interior unit 4 receives an operation setting condition by the wireless signal receiver 37, the interior unit 4 determines an operation condition by the operation setter 35, and controls each of the interior units by the interior unit processor 36 based on the determined operation condition. The interior unit 4 also transmits the operation condition and an operation data to the exterior unit i by the interior-exterior transmitter 32. When the exterior unit i receives the operation condition by the interior-exterior transmission receiver 21, the exterior unit 1 determines a condition of a simultaneous operation of all the interior units by the interior unit operation setter 23, and controls the exterior unit based on the determined operation condition by the exterior unit processor 24. The exterior unit 1 also transmits the operation condition to the interior units 2–4. When the interior units 2–4 receive the operation condition by the interior-exterior transmission receiver 31, the interior units determine the operation condition by the operation setter 35, and controls the interior units based on the determined operation condition by the interior unit processor 36. The interior unit 2 transmits the operation condition and the operation data to the remote-controller 5 by the remote-controller transmitter 34. When the remote-controller 5 receives the operation condition and the operation data by the remote-controller transmission receiver 41 from the interior unit 2, the remote-controller 5 notifies the operation condition and the operation data in a display (not illustrated) by the remote-controller processor When different operation conditions are set by the remote-controller 5 and the remote-controller 10 of a wireless type simultaneously, an operation is performed as explained in the following.

For a purpose of explanation, a case in which "cool"is set by the remote-controller 5 and "dry" is set by the remote-controller 10 of a wireless type is explained.

When the interior unit 2 which is connected to the remote-controller 5 receives a "cool" from the remote-controller 5, the interior unit 2 starts a "cool" operation. When the interior unit 2 receives a "dry" from the remote-controller 10 of a wireless type, the interior unit 4 starts a "dry" operation. When the exterior unit 1 receives different operation setting conditions, i.e., "cool" from the interior unit 2 and "dry" from the interior unit 4, by the interior-exterior transmission receiver 21, the exterior unit 1 determines an operation condition by choosing from the operation setting conditions received from the interior unit 2 and the interior unit 4 based on a priority order which is predetermined by the interior unit operation setter For example, when it is predefined that an interior unit with a bigger unit number has a priority, "dry" which is received from the interior unit 4 is chosen. When the operation condition is determined, the exterior unit 1 is controlled by the exterior unit processor 24, and the operation condition, i.e., "dry" in this example, is transmitted to the interior units 2–4 by the interior-exterior transmitter 22. Then, each of the interior units 2–4 operates simultaneously in a same condition, which is "dry" in this example.

When the interior unit 2 receives a "cool" setting condition from the remote-controller 5 at first, the interior unit 2 starts a "cool" operation. However, when the interior unit 2 receives a new operation setting condition, i.e., "dry" condition from the exterior unit, a "dry" operation which is determined as a condition of the simultaneous operation by the exterior unit is performed. Accordingly, all the interior units begin to operate simultaneously in the same condition.

As stated, the operation setting condition is received from the remote-controller 5 and the remote-controller 10 of a wireless type, and the interior unit 2 which is connected to the remote-controller and the interior unit 4, which receives wireless signals, start operation based on each of received operation setting conditions. Then, the interior units 2 and 4 transmit each of the operation setting conditions to the exterior unit 1, and the exterior unit 1 determines a condition of a simultaneous operation based on a predefined priority order. The operation setting condition is transmitted to each of the interior units 2–4, and all the interior units perform simultaneous operations in the same condition.

As stated, the interior units 2–4 exchange operation data with the exterior unit 1 and the remote-controller 5. Therefore, even if any unit receives different operation setting conditions in any kind of signals from a plurality of remote-controllers in any time, a simultaneous operation control in a same condition is able to be performed without wiring work between the remote-controller 5 and each of the interior units 3 and 4.

In this example, the remote-controller 5 is connected to the interior unit 2, and a signal from the remote-controller 10 of a wireless type is inputted to the interior unit 4. However, the remote-controller 5 may be connected to any interior unit to perform a same operation control. Further, more than two remote-controllers may be operated.

An operation of the interior units is explained with reference to a flow chart of FIG. 5.

Figure 5:
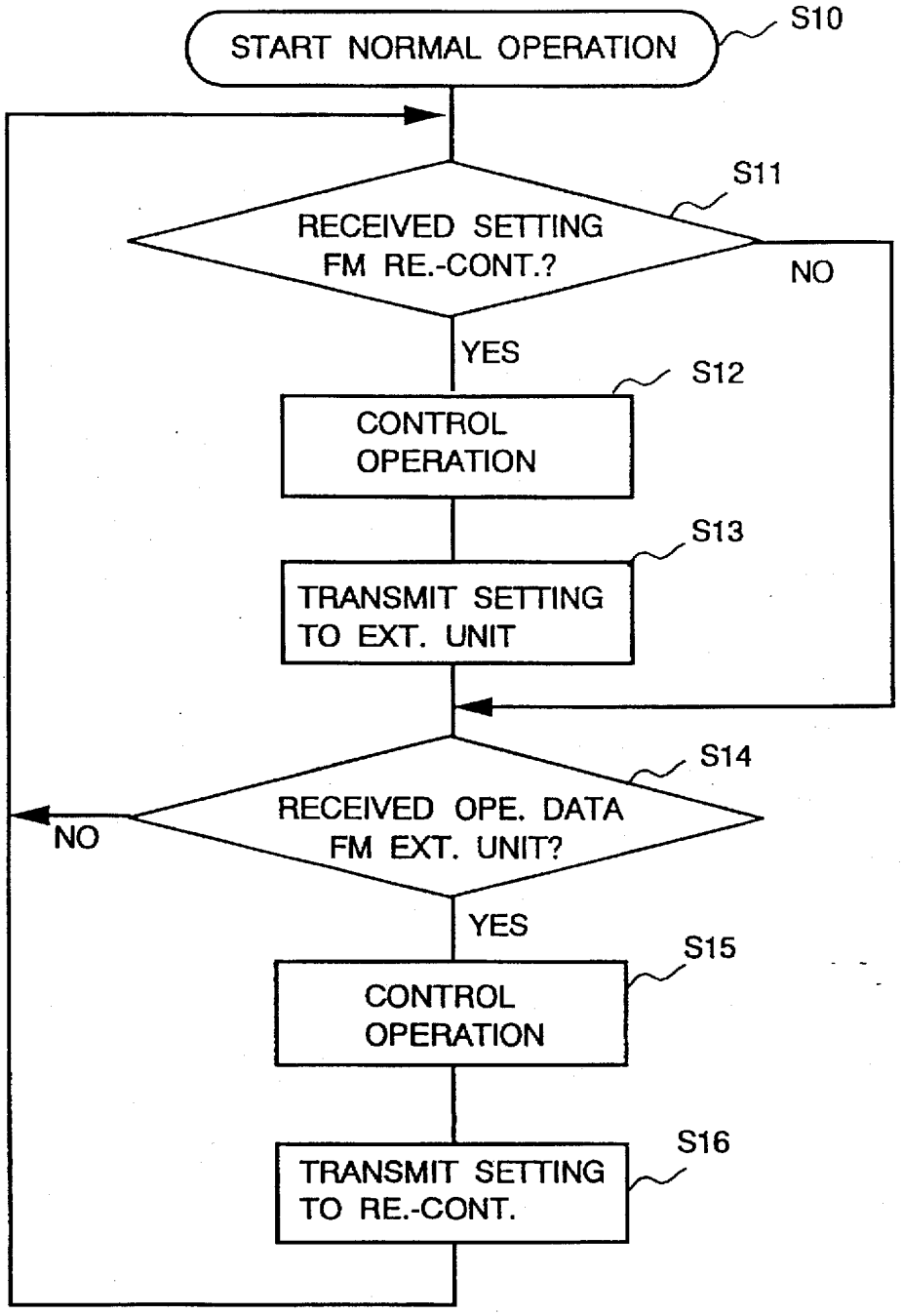
FIG. 5 is a flow chart of an operation of the interior unit of this invention.

In FIG. 5, a normal operation starts in step S10. When an operation setting condition is received from the remote-controller 5 in step S11, the interior units are controlled in the operation setting condition which is received from the remote-controller in step S12. Then, the operation setting condition is transmitted to the exterior unit i in step S13. When the operation setting condition is received from the exterior unit 1 in step S14, the interior unit is controlled in the operation setting condition which is received from the exterior unit 1 in step S15. Then, the operation setting condition is transmitted to the remote-controller 5 in step S16. When the operation setting condition is not received from the remote-controller 5 in step S11, a previous operation control is continued, and the operation in step S14 is performed. When the operation setting condition is not received from the exterior unit 1 in step S14, the previous operation control is continued, and the operation in step S11 is performed.

Even if the operation is controlled according to the operation setting condition which is received from the remote-controller in steps S11 and S12, when a new operation setting condition is received from the exterior unit in step S14, the interior units are controlled based on the new condition. Therefore, even if different operation setting conditions are received by a plurality of interior units, since the exterior unit 1 determines an operation setting condition and transmits the condition to the interior units, each of the interior units operates in the same condition.

Figure 6:
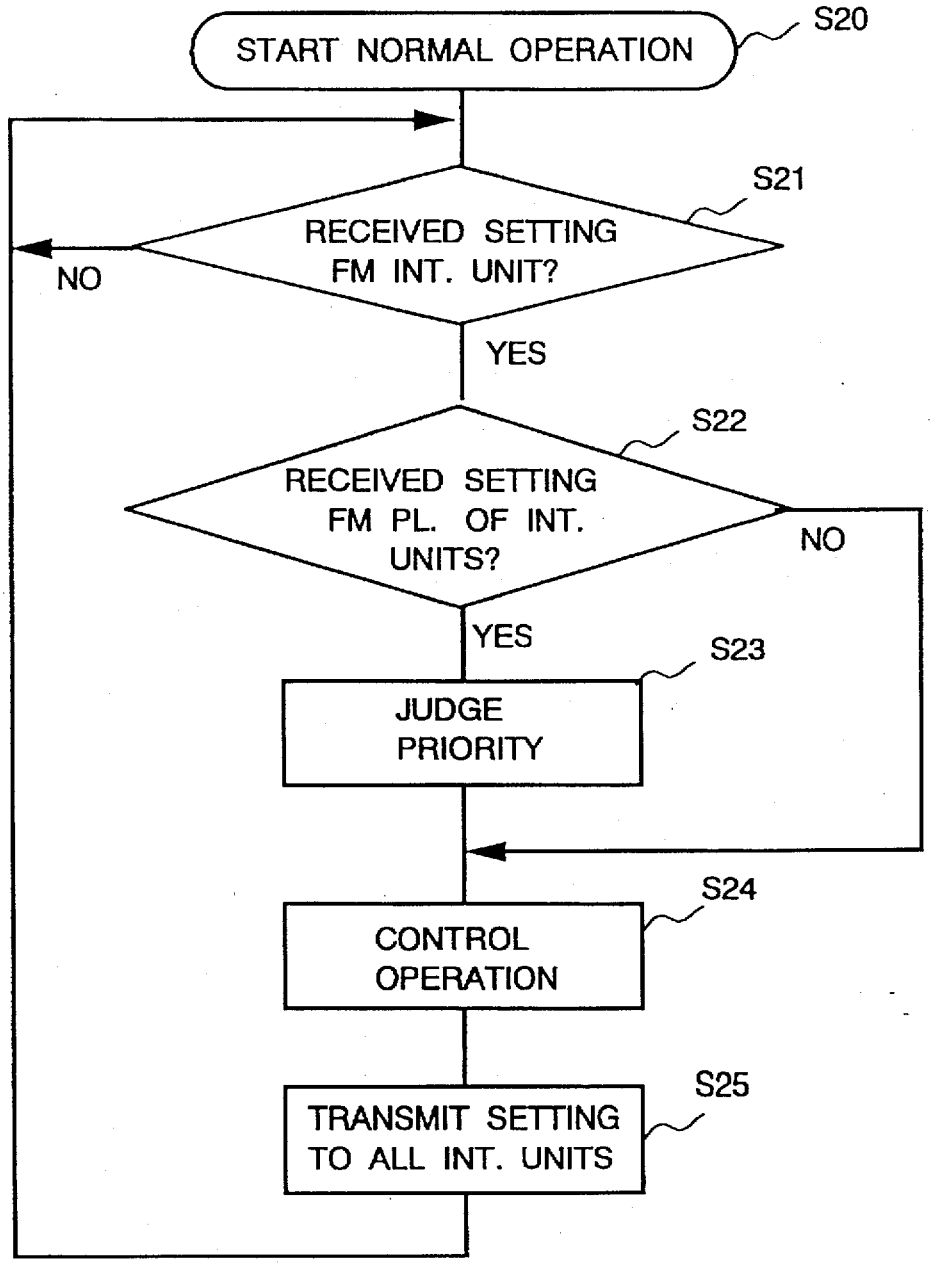
FIG. 6 is a flow chart of an operation of the exterior unit of this invention.

An operation of the exterior unit is explained with reference to the flow chart of FIG. 6.

A normal operation starts in step S20. When an operation setting condition is received from one of the interior units 2–4 in step S21, it is judged if operation conditions are received from a plurality of interior units in step S22. When it is judged that the operation conditions are received from the plurality of interior units in step S22, an operation setting condition is determined based on a predefined priority order in step S23. The exterior unit controls itself in step S24, and transmits the operation setting condition to all of the interior units 2–4. When it is judged that operation setting conditions are not received from the plurality of interior units (an operation setting condition is received from a single interior unit) in step S22, the exterior unit controls itself in the received operation setting condition in step S24. The operation setting condition is transmitted to all the interior units 2–4. When an operation setting condition is not received from any interior unit in step S21, a previous operation control is continued.

As stated, the operation setting conditions are received from a single or a plurality of the interior units, and the condition of simultaneous operations of all the interior units is determined by the exterior unit 1, and all the interior units operate in the same condition. Concerning the priority order, when a priority order is predefined such that a unit with a bigger unit number has a priority, the order is unit 4, unit 3 . . . When a priority order is predefined such that it is based on operation modes, the order is heat, cool, dry, and ventilation, for example.

In the multi-air-conditioner which operates simultaneously, the operation conditions are exchanged between the remote-controller and the interior units by the remote-controller transmission receiver and the remote-controller transmitter in the remote-controller, and the remote-controller transmission receiver and the remote-controller transmitter in the interior units.

The operation conditions are also exchanged between the exterior unit and the interior units by the interior-exterior transmission receiver and the interior-exterior transmitter in the exterior unit, and the interior-exterior transmission receiver and the interior-exterior transmitter in the interior units. Then, a condition of a simultaneous operation of all the interior units is determined by the interior unit operation setter in the exterior unit, and all the interior units are controlled by each of the operation setters of the interior units.

As stated, the air-conditioner of this invention includes the remote-controller transmission receiver and the remote-controller transmitter in the remote-controller and the remote-controller transmission receiver and the remote-controller transmitter in the interior units, and exchanges the operation condition among the remote-controller and the interior units.

The air-conditioner of this invention further includes the interior-exterior transmission receiver and the interior-exterior transmitter in the exterior unit, and the interior-exterior transmission receiver and the interior-exterior transmitter in the interior units, and exchanges the operation condition among the exterior unit and the interior units. The condition of the simultaneous operation of each of all the interior units is determined by the interior unit operation setter in the exterior unit. The interior units are operated by the interior unit operation setter in the interior units. Accordingly, the number of wires, needed to connect the interior units and the remote-controller, is able to be reduced. Further, the number of interior units operated by the remote-controllers is not limited. Even when many interior units are installed, the multi-air-conditioner which operates simultaneously is realized with easy installation work.

Embodiment 2

Figure 7:
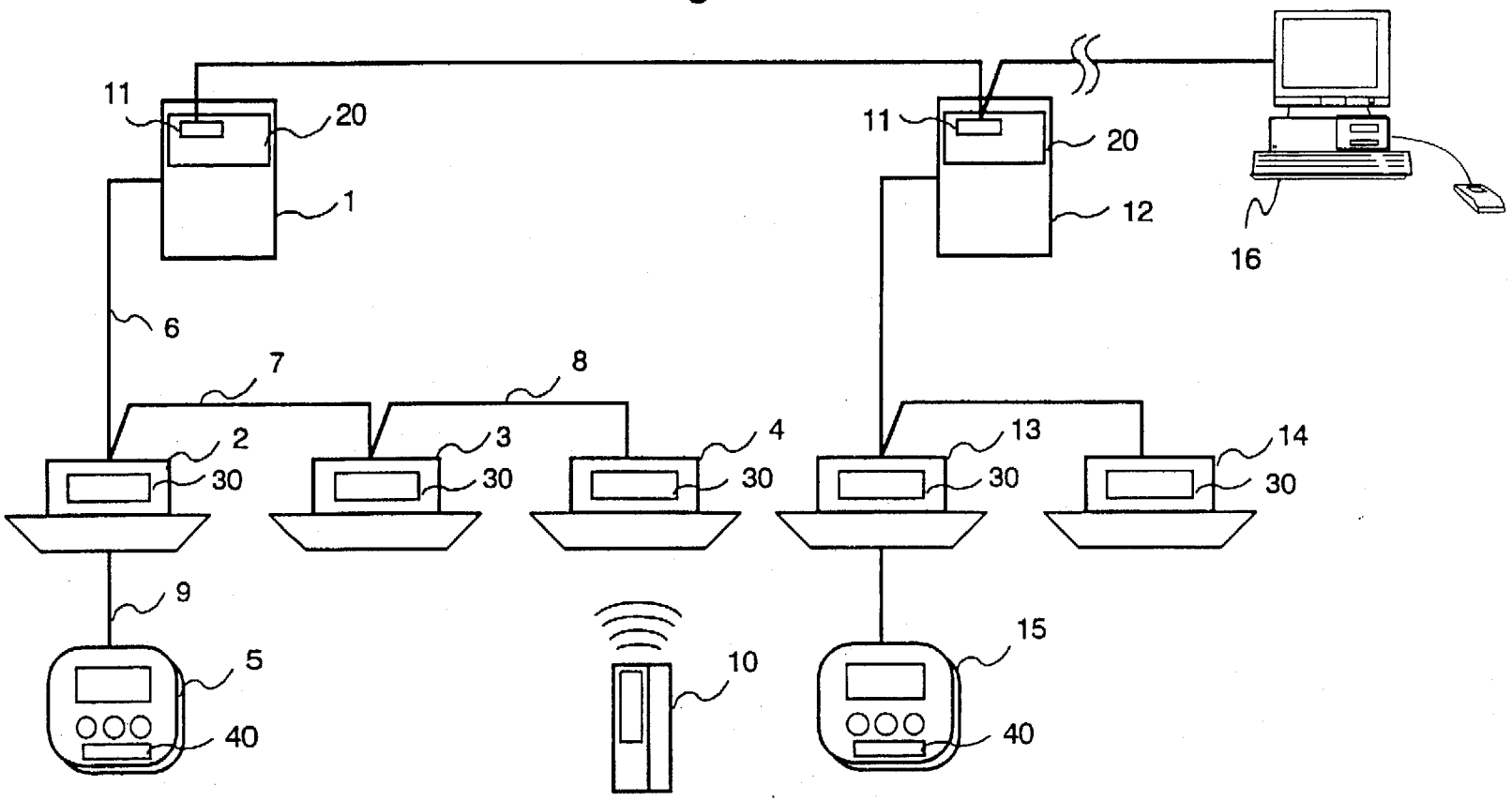
FIG. 7 is a configuration block chart of the multi-air-conditioner of the present invention, which operates simultaneously according to embodiment 2 in this invention.

A configuration of the multi-air-conditioner which operates simultaneously in another embodiment of this invention is illustrated in the block chart of FIG. 7.

In FIG. 7, exterior units 1 and 12, and interior units 2–4 and 13–14 are illustrated. Remote-controllers 5 and 15 of a wired type, and transmission lines 6–8 between the exterior unit 1 and the interior units 2–4 are illustrated. The transmission line 9 between the remote-controller 5 and the interior unit 2 and a remote-controller 10 of a wireless type are also illustrated. A transmission converter 11 exchanges a control condition between a controller (not illustrated) of an air-conditioning control system 16, and the air-conditioning control system 16 performs a centralized control of a plurality of air-conditioners.

Figure 8:
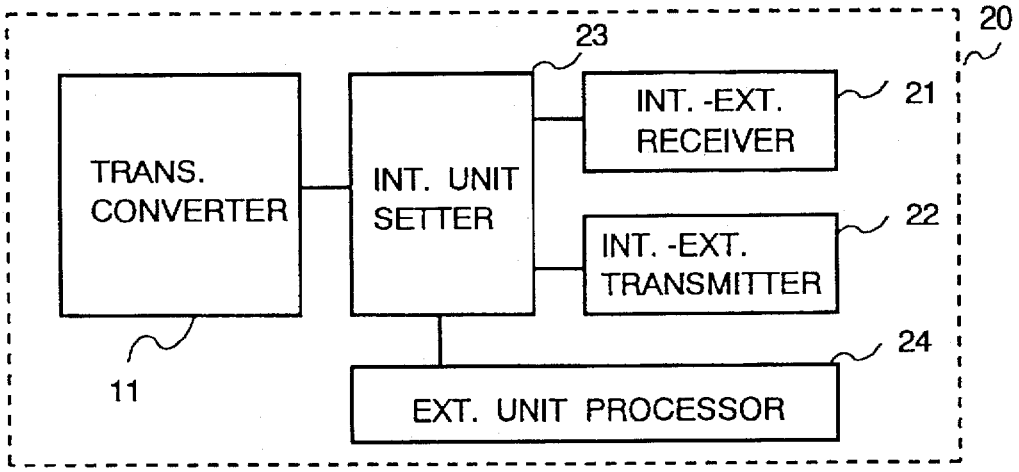
FIG. 8 is a block chart of the controller of the exterior unit which is illustrated in FIG. 7.

A configuration of a controller of the exterior unit 1 of the multi-air-conditioner is illustrated in the block chart of FIG. 8.

Figure 9:
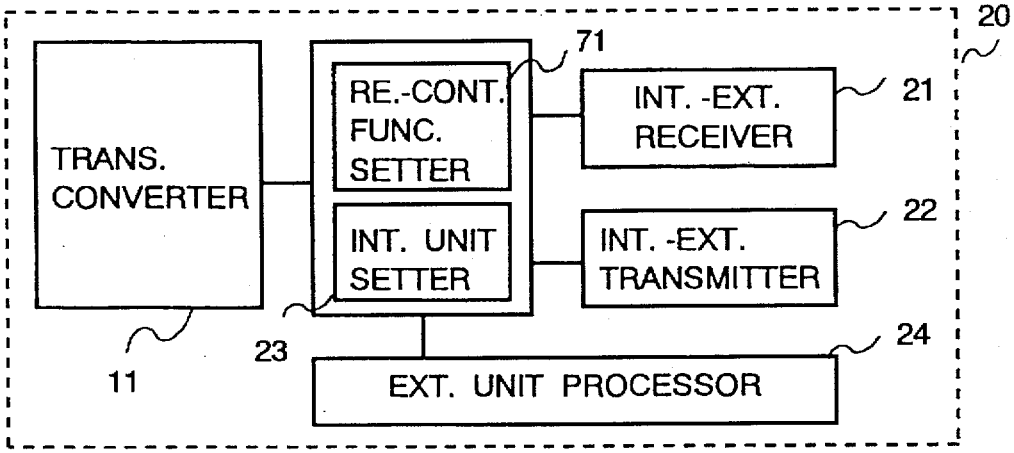
FIG. 9 is a block chart of the controller of the exterior unit of the multi-air-conditioner which operates simultaneously.

A configuration of another controller of the exterior unit 1 of the multi-air-conditioner is illustrated in the block chart of FIG. 9.

Figure 10:
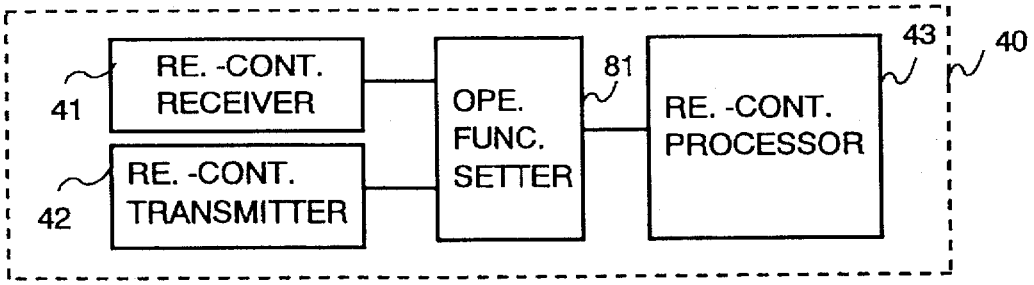
FIG. 10 is a block chart of the controller of the remote-controller of a wired type in the multi-air-conditioner which operates simultaneously.
Figure 11:
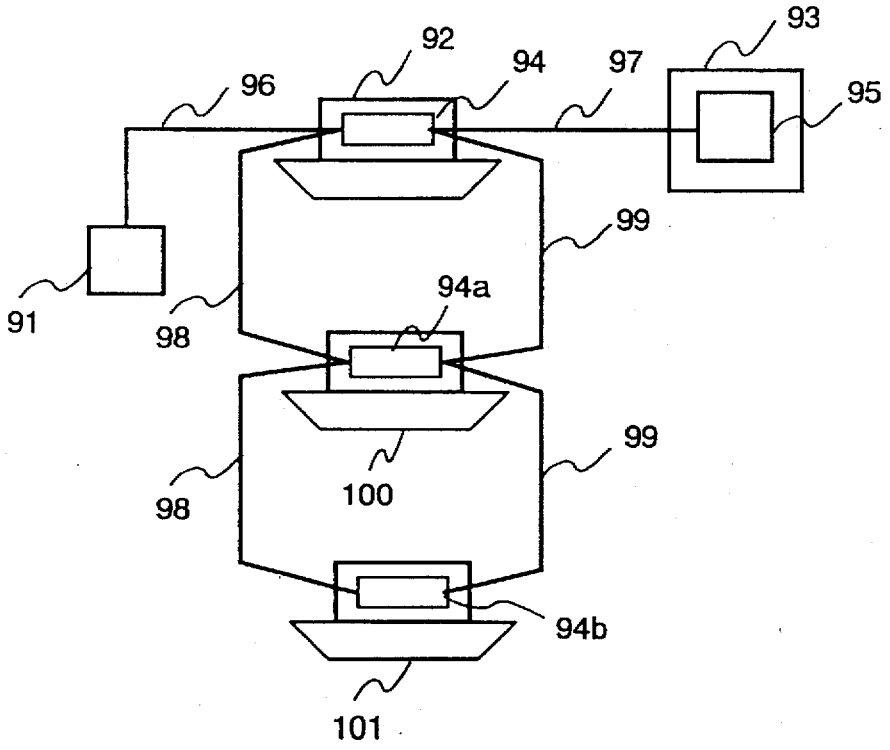
Fig. 11 RELATED ART
FIG. 11 is a system configuration chart of the multi-air-conditioner which operates simultaneously according to the related art.

A configuration of a controller of the remote-controller of the multi-air-conditioner is illustrated in the block chart of FIG. 10.

In FIG. 9, a remote-controller function setter 71 sets functions which are possible to operate by an instruction of the remote-controllers 5 and 15 or the air-conditioning control system 16 based on operation data of each of the interior units which is received by the interior-exterior transmission receiver 21. The remote-controller function setter 71 is a function setter which is provided in the exterior unit.

In FIG. 10, an operation function setter 81 sets functions which are possible to operate based on a remote-control function data which is received by the remote-controller transmission receiver 41.

An operation of an embodiment of the multi-air-conditioner which operates simultaneously is performed as explained in the following.

In FIG. 7, the interior units 2–4 are connected to the exterior unit 1, and interior units 13 and 14 are connected to exterior unit 12. The remote-controller 5 is connected to the interior unit 2, and the remote-controller 15 is connected to the interior unit 13. The air-conditioning control system 16 is connected to each of the exterior units 1 and 12 via each of the transmission converters 11. The operation is controlled by the remote-controllers 5 and 15, the remote-controller 10 of a wireless type and the air-conditioning control system 16.

When operation conditions of the interior units 2–4 are set by the air-conditioning control system 16, an operation is performed as follows.

The controller of the exterior unit 1 is configured as illustrated in FIG. 8. When the exterior unit 1 receives an operation setting condition from the air-conditioning control system 16 by the transmission converter 11, a condition of the simultaneous operation of all the interior units is determined by an interior unit operation setter 23. The exterior units are controlled by the exterior unit processor 24 based on the determined operation condition. The operation condition is also transmitted to the interior units 2–4 by the interior-exterior transmitter 22. When the operation condition is received by the interior units 2–4 by the interior-exterior transmission receiver 31, the operation condition is determined by the operation setter 35, and the interior units are controlled by the interior unit processor 36 based on the determined operation condition. At the same time, the interior unit 2 transmits the operation condition and the operation data to the remote-controller 5 by the remote-controller-transmitter. When the remote-controller 5 receives the operation condition and the operation data from the interior unit 2 by the remote-controller transmission receiver 41 which is illustrated in FIG. 10, the remote-controller 5 informs the operation condition and the operation data by using a display (not illustrated), etc. by the remote-controller processor 43.

When the operation condition is set by the remote-controller 5, an operation is performed as follows.

When the interior unit 2 receives an operation setting condition from the remote-controller 5 by the remote-controller transmission receiver 33, the interior unit 2 determines the operation condition by the operation condition setter 35, and controls the interior units by the interior unit processor 36 based on the determined operation condition. At the same time, the operation condition and the operation data are transmitted to the exterior unit 1 and the remote-controller 5 by the interior-exterior transmitter 32 and the remote-controller transmitter 34. When the exterior unit 1 receives the operation condition by the interior-exterior transmission receiver 21, the exterior unit 1 determines the condition of the simultaneous operation of all the interior units by the interior unit operation setter 23. The exterior unit is controlled by the exterior unit processor 24 based on the determined operation condition. Further, the operation condition is transmitted to the interior units 2–4 by the interior-exterior transmitter 22. The operation condition and the operation data are transmitted to the air-conditioning control system 16 by the transmission converter 11. When the interior units 2–4 receive the operation condition by the interior-exterior transmission receiver 31, the operation condition is determined by the operation setter 35 and the interior units are controlled by the interior unit processor 36 based on the determined operation condition.

As stated, when a transmission converter is provided in the exterior unit, a centralized control and operation control of the air-conditioner by the air-conditioning control system 18 is made possible without a complicated installation work.

The transmission converter performs signal conversion of a transmission between the interior unit and the exterior unit. The transmission converter performs signal conversion of a transmission between the exterior unit and an upper control unit. The transmission converter may be provided in the controller in advance as illustrated in FIGS. 8 and 9. The transmission converter may also be installed later as an adapter as in the configuration of FIGS. 1 and 2.

When the controller of the multi-air-conditioner which operates simultaneously is configured as illustrated in FIG. 9, an operation is performed as explained in the following.

The interior units 2–4 transmit functions, which are already provided in each of the interior units, e.g., a "louver" function (a continuous ventilation of left and right wind), a "vane swing" function (a continuous ventilation of up and down wind), etc., to the exterior unit 1 by the interior-exterior transmitter 32. When the exterior unit 1 receives the function data of each of the interior units 2–4 by the interior-exterior transmission receiver 21, the exterior unit 1 determines function items which are able to be set by the remote-controller and the controller of the air-conditioning control system by the remote-controller function setter 71, and the function data is transmitted to the interior unit 2 by the interior-exterior transmitter 22. The interior unit 2 transmits the function data which is received by the interior-exterior transmission receiver 31 to the remote-controller 5 by the remote-controller transmitter 34. When the remote-controller 5 receives the function data from the interior unit 2 by the remote-controller transmission receiver 41, the remote-controller 5 sets function items which are able to be operated by the operation function setter 81.

For example, when the exterior unit 1 sets a remote-control function data as "with louver, without vane swing", the remote-controller 5 cancels a "vane swing" (a continuous ventilation of up and downwind) setting, which is set by a setting switch (not illustrated), by the remote-controller processor 43 via the operation function setter 81.

In the case of the air-conditioning control system 16, the function setting operation is performed in the same way. The exterior unit i transmits a function data to the air-conditioning control system 16 via the transmission converter 11. The air-conditioning control system 16 sets function items which are able to be operated.

As stated, function items which are operated by the remote-controller are able to be set regardless of functions which are provided in the interior unit connected to the remote-controller. The operation function setter 81 may be provided in one of the interior units instead of the remote-controller, and the function data which is transmitted from the remote-controller may be converted by the operation function setter 81 in the interior unit.

The operation of the multi-air-conditioner which operates simultaneously is further explained.

The interior units 2–4 transmit the function data, e.g., "louver" function, "vane swing" function, etc., which are already provided in the interior units, to the exterior unit 1 by the interior-exterior transmitter 32. When the exterior unit 1 receives the function data of each of the interior units 2–4 by the interior-exterior transmission receiver 21, the remote-controller function setter 71 determines function items which are able to be set for operation by the remote-controller or the controller of the air-conditioning control system 16 by using a logic disjunction of functions of each of the interior units. The determined function items are transmitted to the interior unit 2 by the interior-exterior transmitter 22. The interior unit 2 transmits the function items, which are received by the interior-exterior transmission receiver 31, to the remote-controller 5 by the remote-controller transmitter 34. When the remote-controller 5 receives the function data from the interior unit 2 by the remote-controller transmission receiver 41, the operation function setter 81 sets the function items which are able be operated.

When the interior unit 2 is set in a condition of "with louver, without vane swing", and the interior units 3 and 4 are set in a condition of "without louver, with vane swing", the exterior unit 1 sets a condition of "with louver, with vane swing" which is a logic disjunction of the functions as a function setting data. The setting condition is transmitted to the remote-controller 5 via the interior unit 2, and the remote-controller 5 effects both of the "louver" (continuous ventilation of left and right wind) setting function and the "vane swing" (a continuous operation of up and down wind) setting function which are set by the setting switch (not illustrated) by the remote-control processor 43 via the remote-controller transmission receiver 41 and the operation function setter 81.

When both of "louver" and "vane swing" functions are set by the setting switch of the remote-controller 5, the remote-controller 5 transmits a signal of louver setting ="ON" and a signal of vane swine setting="SWING" by the remote-controller transmitter 42 simultaneously. The interior unit 2 which is connected to remote-controller 5 receives the signals of louver setting="ON" and vane swing setting= "SWING" simultaneously with other operation setting conditions. Since the function data of the interior unit 2 is "with louver, without vane swing", the interior unit 2 performs an operation of "louver=ON" (a continuous ventilation of left and right wind) which is able to be operated by itself.

Since the interior unit 2 doesn't have a vane swing function, a continuous ventilation of up and down wind is not performed. The interior unit 2 transmits the signal of louver setting="ON" and the signal of vane swing setting= "SWING" to the exterior unit 1 together with other operation setting data.

The exterior unit 1 receives the operation setting data by the interior-exterior transmission receiver 21, and transmits the signals of louver setting="ON" and vane swing setting= "SWING" with other operation setting data to the interior units 2–4 by the interior-exterior transmitter 22. Since the interior units 3 and 4 are set as "without louver, with vane swing", when the interior units 3 and 4 receive the operation setting data by the interior-exterior transmission receiver 31, the interior units 3 and 4 perform an operation of a vane swing, a continuous ventilation of up and down wind, without performing a continuous ventilation of left and right wind.

In the multi-air-conditioner which operates simultaneously according to the related art, when a unit connected to the remote-controller does not have a vane swing function, even if the other interior units connected to the same exterior unit have the vane swing function, it is impossible to turn the vane setting to "SWING." When the unit connected to the remote-controller does not have a louver function, even if the other interior units have the louver function, it is impossible to turn the louver setting to "ON." However, in the present invention, both are made possible in the multi-air-conditioner which operates simultaneously.

In the above example, units of a louver type and units of a swing type are mixed. However, when units with two ventilation levels and units with four ventilation levels are mixed, an operation is performed in the same way.

The exterior unit 1 sets "four ventilation levels" which is a disjunction as a remote-control function data. The setting data is transmitted to the remote-controller 5 via the interior unit 2. The remote-controller 5 operates by the remote-controller processor 43 via the remote-controller transmission receiver 41 and the operation function setter 81 so that each of ventilation levels (low, medium low, medium high, high) are to be effected by the setting switch (not illustrated). For example, the interior unit 2 is with only one ventilation level, the interior unit 3 is with two ventilation levels and the interior unit 4 is with four ventilation levels, and the remote-controller sets a ventilation level of "medium high." Since the interior unit 2 has only one ventilation level, the ventilation level of the interior unit 2 is fixed, at "high", for example. The interior unit 2 operates in a ventilation level of "high", and a ventilation level of "medium high" is sent to the interior unit 3 by the interior-exterior transmitter 32. The interior unit 3 has two ventilation levels. The interior unit 3 is predetermined, for example, that when one of "low", "medium low" and "medium high" levels is received, the ventilation at a low level is performed and when "high" is received, the ventilation at a high level is performed. Therefore, when "medium high" is received, ventilation at a low level is performed. Since the interior unit 4 has four ventilation levels, the interior unit 4 performs the ventilation at a "medium high" level.

As stated, according to the related art, when the remote-controller is connected to a unit with one ventilation level, even when the other interior units connected to the same interior unit has either two or four ventilation levels, it is impossible to control ventilation levels in the multi-air-conditioner which operates simultaneously.

When the remote-controller is connected to a unit with two ventilation levels even when the other interior units have four ventilation levels, it is impossible to control the ventilation level in four levels. However, according to the present invention, both are made possible in the multi-air-conditioner which operates simultaneously.

In this invention, the remote-controller is able to set all the functions of each of the interior units regardless of functions of a certain interior unit which is operated by the remote-controller.

In the case of the air-conditioning control system 16, the exterior unit i transmits function data to the air-conditioning control system via the transmission converter 11, and sets function items which are able to be operated.

The function data of each of the interior units is able to be set by a switch on a board, etc. It is also able to be set by exchanging data between the remote-controller and the interior unit 2 which is connected to the remote-controller or between each of the interior units 2–4 and the exterior unit 1 by the remote-controller transmitter 42 of the remote-controller, the remote-controller transmission receiver 41, the remote-controller transmitter 34 of each of the interior units 2–4, the remote-controller transmission receiver 33, the interior-exterior transmitter 32, the interior-exterior transmission receiver 31, the interior-exterior transmitter 22 of the exterior unit 1, and the interior-exterior transmission receiver 21.

For example, when the remote-controller sets the interior unit 2 as "with louver, without vane swing", the remote-controller transmits data for the interior unit 2 which is "with louver, without vane swing", and the interior unit 2 sets its function as "with louver, without vane swing." For setting the interior units 3 and 4 to be "without louver, with vane swing", the interior unit 2, which is connected to the remote-controller by a wire, receives data of "without louver, with vane swing" for the interior unit 3 and data of "without louver, with vane swing" for the interior unit 4 from the remote-controller. Then, the interior unit 2 transmits the data to the exterior unit 1, and the exterior unit 1 transmits the data to the interior units 3 and 4. When the interior units 3 and 4 receive the data, they set their function as "without louver, with vane swing."

In the multi-air-conditioner of this invention which operates simultaneously, data is exchanged between the transmission converter of the exterior unit and a controller in a centralized air-conditioning control system which controls a plurality of air-conditioners. Accordingly, the multi-air-conditioner which operates simultaneously is set for operation and controlled by the controller of the air-conditioning control system.

The multi-air-conditioner which operates simultaneously includes the transmission converter in the exterior unit.

Control data is exchanged between the transmission converter in the exterior unit and the controller of the centralized air-conditioning control system which controls a plurality of air-conditioners. Accordingly, the multi-air-conditioner which operates simultaneously is set for operation and controlled by the controller of the air-conditioning control system. Therefore, the number of interior units are able to be easily increased, and installation work is performed easily.

Furthermore, when the transmission converter is provided in the exterior unit, the air-conditioning control system 16 is able to control the air-conditioner in a centralized method without complex installation work with a low cost. When an interior unit doesn't have a space for the transmission converter, the air-conditioning control system 16 performs centralized control and operation control of the air-conditioner.

In the multi-air-conditioner which operates simultaneously, the interior-exterior transmission receiver in the exterior unit collects function data of each of the interior units, and the remote-controller function setter determines functions which are able to be set for operation by either the remote-controller or the controller of the air-conditioning control system. Then, the determined functions are transmitted to the remote-controller via the interior units. The remote-controller automatically sets functions which are able to be operated based on the data which is received by the remote-controller transmission receiver.

In the multi-air-conditioner which operates simultaneously, the interior-exterior transmission receiver in the exterior unit collects function data of each of the interior units, and the remote-controller function setter determines function items which are able to be operated by the remote-controller or the controller of the air-conditioning control system. The data are transmitted to the remote-controller via the interior units. Functions which are able to be operated are automatically set by the remote-controller function setter based on data which are received by the remote-controller transmission receiver in the remote-controller. Hence, the function items which are operated by the remote-controller are able to be set regardless of functions of the interior unit which is connected to the remote-controller.

In the multi-air-conditioner which operates simultaneously, the interior-exterior transmission receiver of the exterior unit collects function data of each of the interior units, and the remote-controller function setter sets the remote-control function by a disjunction of functions of each of the interior units.

In the multi-air-conditioner which operates simultaneously, the interior-exterior transmission receiver in the exterior unit collects function data of each of the interior units. The remote-controller function setter sets the remote-control function by a disjunction of the functions of each of the interior units. Therefore, the remote-controller is able to set all the functions of the interior units regardless of functions of a certain interior unit.

According to the air-conditioner of the present invention, the number of wires needed to connect the interior units and the number of wires needed to connect the interior units and operation commanders such as the remote-controller are able to be reduced. An air-conditioner which has an advantage of easy installation work is also realized.

According to the air-conditioner of the present invention, even when many interior units with different functions are used, a multi-operation according to a same command is possible. Also, a system including many interior units with different functions, which is easy to handle, is realized.

According to the air-conditioner of the present invention, with a simple configuration of the interior units, the multi-air-conditioner which operates in a same condition is realized.

According to the air-conditioner of the present invention, a number of wires connecting from the remote-controller is able to he reduced. Also, an air-conditioner which has an advantage of easy installation work can be realized.

According to the air-conditioner of the present invention, a centralized control and an operation control by simple interior units can be realized.

According to the air-conditioner of the present invention, a plurality of interior units are able to operate by a same command regardless of functions of each of the interior units.

According to the air-conditioner of this invention, remote-controllers are able to optimize operations of a plurality of interior units regardless of function of each of the interior units and the remote-controllers.

According to the air-conditioner of this invention, a plurality of interior units operates by a same command based on all the functions of each of the interior units. Therefore, the plurality of interior units operates in a same condition so that functions of each of the plurality of interior units are optimized.

Having thus described several particular embodiments of the invention, obviously various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and it is therefore understood within the scope of the appended claims, the invention may be practiced othwise than as specifically described herein.

What is claimed as new and desired to be secured by letters patent of the United States is:

1. An air-conditioner comprising:

an exterior unit;

a plurality of interior units connected to the exterior unit;

a transmitter which transmits data between the exterior unit and the plurality of interior units connected to the exterior unit;

an operation commander, connected to at least one of the exterior unit and the plurality of interior traits, which sets a same operation condition for causing all of the interior units to operate in a same condition; and a controller, provided in the exterior unit, for collecting operation data from the interior units based on a command from the operation commander, for determining the same operation condition for each of the interior units based on the collected operation data from the interior units, and for instructing each of the interior units to perform the determined same operation condition via the transmitter;

wherein each of the plurality of interior units operates in the same operation condition based on the instruction from the controller.

2. The air-conditioner of claim 1, wherein the controller collects function data of the interior units as the operation data and determines the same operation condition which is able to be set for the interior units based on the collected function data of the interior units; and wherein at least one of the operation commander and the interior units comprises an operation function setter which automatically sets the same operation condition received from the controller, as an operation condition which is able to be operated by at least one of the operation commander and the interior units.

3. The air-conditioner of claim 1, further comprising an air-conditioning control system for centrally controlling the exterior unit and having an external controller;

wherein the exterior unit comprises a transmission converter which converts signals transmitted between the interior units and the exterior unit and between the exterior unit and the external controller of the air-conditioning control system which controls the exterior unit centrally.

4. The air-conditioner of claim 1, wherein the exterior unit comprises a remote-controller function setter which determines the same operation condition which is able be set for all of the interior units as a function of data collected from the interior units and transmits the same operation condition to at least one of the operation commander and the interior units.

5. The air-conditioner of claim 4, wherein at least one of the operation commander and the interior units comprises an operation function setter which receives the same operation condition determined by the remote controller function setter of the exterior unit, and automatically sets functions which are able to be operated by the respective interior units.

6. The air-conditioner of claim 4, wherein the remote controller function setter sets the same operation condition based on a disjunction of the collected data of each of the interior units.

7. An air-conditioner comprising:

a single or a plurality of exterior units; and a single or a plurality of interior units connected to the exterior units;

wherein:

each interior unit of the single or plurality of interior units operates in a same operation condition when so commanded;

each exterior unit, includes, an interior-exterior transmission receiver which collects operation data of each of the interior units, an interior unit operation setter which determines the same operation condition for all of the interior units based on the collected operation data of each of the interior units, and an interior-exterior transmitter which transmits the same operation condition to each of the interior units;

each interior unit, includes, an interior-exterior transmitter which transmits the operation data to the exterior units, an interior-exterior transmission receiver which receives the same operation condition from the exterior units, and an operation setter which sets an internal operation condition based on the same operation condition received from the exterior units.

8. The air-conditioner of claim 7, further comprising an operation commander, connected to at least one of the interior units and the exterior units, which sets the same operation condition.

9. The air-conditioner of claim 8, wherein the operation commander is connected to at least one of the interior units, and includes a single or a plurality of remote-controllers for setting the same operation condition, wherein the each interior unit further comprises:

a remote controller transmission receiver which receives the internal operation condition from the remote-controller, an operation setter which sets an operation condition based on the internal operation condition from the remote controller, and a remote-controller transmitter which transmits the set operation condition to the remote-controller, wherein each remote-controller comprises a remote-controller transmission receiver which receives the set operation condition from the interior units, and a remote-controller transmitter which transmits the internal operation condition to the interior units.

10. The air-conditioner of claim 7, further comprising an air-conditioning control system for centrally controlling the exterior unit and having an external controller;

wherein the exterior unit comprises a transmission converter which converts signals between the interior units and the exterior unit and between the exterior unit and the controller of the air-conditioning control system which controls the exterior unit centrally.

11. The air-conditioner of claim 8, wherein the exterior unit comprises a remote-controller function setter which determines the same operation condition which is able be set for all of the interior units as a function of data collected from the interior units and transmits the same operation condition to at least one of the operation commander and the interior units.

12. The air-conditioner of claim 11, wherein at least one of the operation commander and the interior units comprises an operation function setter which receives the same operation condition determined by the remote controller function setter of the exterior unit, and automatically sets functions which are able to be operated by the respective interior units.

13. The air-conditioner of claim 11, wherein the remote controller function setter sets the same operation condition based on a disjunction of the collected data of each of the interior units.

14. A control method for an air-conditioner having an exterior unit, a plurality of interior units connected to the exterior unit, a transmitter which transmits data between the exterior unit and the plurality of interior units and is connected to the exterior unit, and an operation commander, connected to at least one of the exterior unit and the interior units, which sets a same operation condition so that all of the interior units operate in a same condition regardless of internal operation conditions of each internal unit, comprising:

an interior unit control step, which includes controlling the interior units based on the same operation condition from the operation commander, and when a new same operation condition is received from the exterior units, controlling the interior units based on the new same operation condition; and an exterior unit control step, which includes receiving the internal operation conditions from at least one interior unit of the plurality of interior units, determining the same operation condition based on the received internal operation conditions, and transmitting the same operation condition to each of the interior units so that each of the interior units operate in a same operation condition.

15. The control method of claim 14, wherein the interior unit control step includes the steps of:

receiving an operation condition from the operation commander;

controlling the interior units based on the received operation condition from the operation commander;

transmitting the received operation condition to the exterior unit;

receiving the same operation condition from the exterior unit;

controlling the interior units based on the same operation condition received from the exterior unit; and transmitting the same operation setting condition to the operation commander.

16. The control method of claim 15, wherein the exterior unit control step comprises the steps of:

receiving internal operation conditions from one of the interior units;

judging if internal operation conditions are received from a plurality of interior units;

determining the same operation condition based on a predetermined priority order, when it is judged that internal operation conditions are received from a plurality of interior units;

controlling at least one interior unit of the plurality of interior units based on the determined same operation condition; and transmitting the same operation condition to all the interior units.

17. The control method of claim 14, wherein the exterior unit control step includes the steps of:

collecting internal function data from each of the interior units and determining the same operation condition which is set for all of the interior units based on the internal function data of the interior units; and transmitting the determined same operation condition to each of the interior units via the transmitter; and wherein the interior unit control step includes a step of automatically setting the transmitted same operation condition as an internal operation condition to be operated by each of the interior units and the operation commander.

* * * * *

UNITED STATES PATENT AND TRADEMARK OFFICE

CERTIFICATE OF CORRECTION

PATENT NO. : 5,743,101

DATED : APRIL 28, 1998

INVENTOR(S) : YASUNORI SHIDA ET AL

It is certified that error appears in the above-identified patent and that said Letters Patent is hereby corrected as shown below:

Column 1, line 27, change "98" to --96--.

Column 2, line 18, change ",units," to --units,--.

Column 4, line 52, delete "20".

Column 4, lines 52-53, after "transmitter" insert --34.--.

Column 4, line 67, after "processor" insert --36.--.

Column 5, line 18-19, change "i" to --1--.

Column 5, line 39, after "processor" insert --43.--.

Column 5, line 59, after "setter" insert --23.--.

Column 6, line 45, change "i" to --1--.

Column 9, line 48, change "18" to --16--.

Signed and Sealed this

Twenty-third Day of March, 1999

*Attest:*

Q. TODD DICKINSON

*Attesting Officer*

*Acting Commissioner of Patents and Trademarks*